US005381921A

United States Patent [19]

Bray et al.

[11] Patent Number: 5,381,921

[45] Date of Patent: Jan. 17, 1995

[54] REFUSE CONTAINERS

[75] Inventors: David A. Bray, Lytham St. Annes; Robert Dixon, Preston, both of United Kingdom

[73] Assignee: Glasdon Group Limited, Liverpool, United Kingdom

[21] Appl. No.: 952,521

[22] PCT Filed: Jun. 11, 1991

[86] PCT No.: PCT/GB91/00934

§ 371 Date: Dec. 8, 1992

§ 102(e) Date: Dec. 8, 1992

[87] PCT Pub. No.: WO91/19656

PCT Pub. Date: Dec. 26, 1991

[30] Foreign Application Priority Data

Jun. 12, 1990 [GB] United Kingdom ..... 9013050

[51] Int. Cl.[6] ..... B65D 25/00

[52] U.S. Cl. ..... 220/404; 220/409; 220/908

[58] Field of Search ..... 220/404, 908, 408, 409

[56] References Cited

U.S. PATENT DOCUMENTS

| | | | |
|---|---|---|---|
| 1,285,477 | 11/1918 | Valentine | 220/908 X |
| 2,322,439 | 6/1943 | Heithoff | 220/409 X |
| 2,500,466 | 3/1950 | Myers | 220/409 X |
| 3,807,598 | 4/1974 | Nutt | 220/908 X |
| 3,964,630 | 6/1976 | Getz | 220/404 |
| 4,081,105 | 3/1978 | Dagonnet et al. | 220/409 X |
| 4,159,139 | 6/1979 | Gawedzinski | 294/55 |
| 4,445,619 | 5/1984 | Kubic et al. | 220/409 X |
| 4,457,549 | 7/1984 | Lowery | 294/55 |
| 4,577,778 | 3/1986 | Kim | 220/908 X |
| 4,630,752 | 12/1986 | DeMars | 220/908 X |
| 4,765,579 | 8/1988 | Robbins, III et al. | 220/908 X |
| 4,913,308 | 4/1990 | Culbertson | 220/908 X |
| 4,948,266 | 8/1990 | Bemcic | 383/34 |
| 4,953,740 | 9/1990 | Koda | 220/908 X |

FOREIGN PATENT DOCUMENTS

| | | |
|---|---|---|
| 342158 | 12/1959 | Switzerland . |
| 1146996 | 3/1969 | United Kingdom . |
| 2195523 | 4/1988 | United Kingdom . |
| 2197288 | 5/1988 | United Kingdom . |
| WO82/02701 | 8/1982 | WIPO . |

OTHER PUBLICATIONS

Rubbermaid Brochure (estimated 1978).

*Primary Examiner*—Steven M. Pollard

*Attorney, Agent, or Firm*—Pravel Hewitt Kimball & Krieger

[57] ABSTRACT

A refuse container comprising a hollow body with an upper access opening closed by a displaceable cover, and a bag suspension frame, carried by a body wall, said wall movable between a closed position in which the frame is positioned below an access opening, and an open position in which the frame is exposed for bag replacement. The frame has a movable frame element projecting away from the wall. The body has internal surfaces for deflecting the frame element upwardly during closing movement and downwardly during opening movement of the body wall.

5 Claims, 2 Drawing Sheets

REFUSE CONTAINERS

This invention relates to refuse containers, e.g. litter bins or household dustbins.

It is known to line such a container with a disposable bag which is held open by stretching its mouth over an upper edge of the container. This can be difficult to achieve manually and may result in an untidy appearance of the bin if the overlap is too great. The bag is also prone to detachment from the container edge resulting in penetration of refuse between the bag and the container.

It is also known to suspend the bag freely from a fixed frame which provides an edge over which the mouth of the bag is turned. In this case slippage of the bag may result in spillage of refuse.

It is an object of the present invention to provide a refuse container in which the aforementioned disadvantages are obviated or mitigated.

According to a first aspect of the present invention there is provided a refuse container comprising a hollow body with an upper access opening closed by a displaceable cover, and a bag suspension frame carried by a body wall movable between a closed position in which the frame is positioned below the access opening and an open position in which the frame is exposed for bag replacement, said frame having a movable frame element projecting away from the wall and the body having internal surfaces for deflecting said frame element upwardly during closing movement and downwardly during opening movement of the wall.

According to a second aspect of the present invention there is provided a refuse container comprising a supporting frame including frame elements engageable with the mouth of a disposable bag and movable relatively apart into a stable over-centre position in which the bag mouth is held open in use.

The invention will now be further described by way of example only with reference to the accompanying drawings, in which.

Figure 2A:
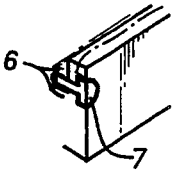
FIG. 2A is a detail showing a rivet around which the supporting frame pivots.
Figure 2B:
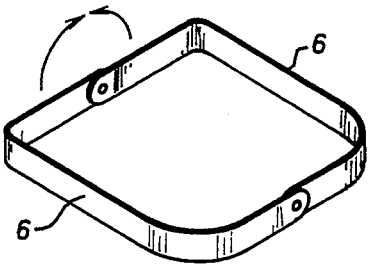
FIG. 2 is a corresponding plan view.
Figure 2:
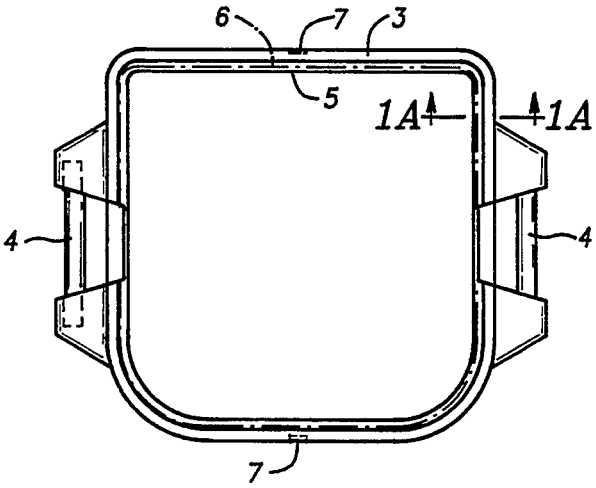

FIG. 2B further illustrates the supporting frame and its capability to pivot.

Figure 1B:
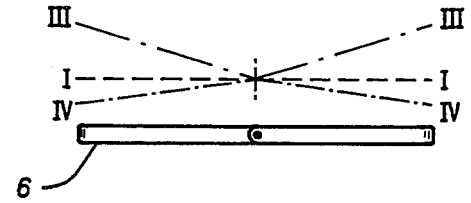
FIG. 1B is a side view of the supporting frame.
Figure 3:
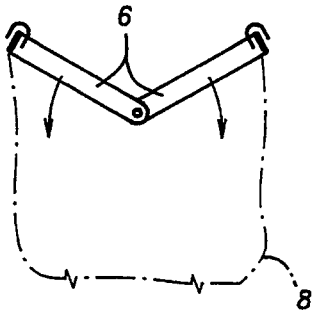
Figure 1:
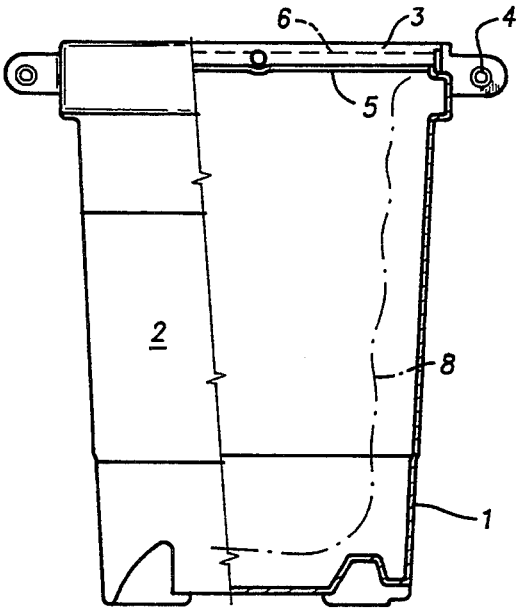
FIG. 1 is a partly cut-away side view of a refuse container with a refuse bag held in position by one embodiment of supporting frame in accordance with the invention.
Figure 1A:
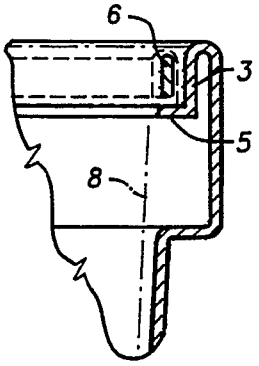
FIG. 1A is a sectional view on line 1A—1A of FIG. 2.
Figure 4:
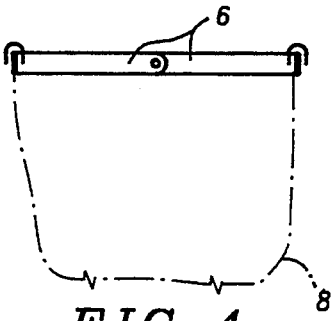
Figure 5:
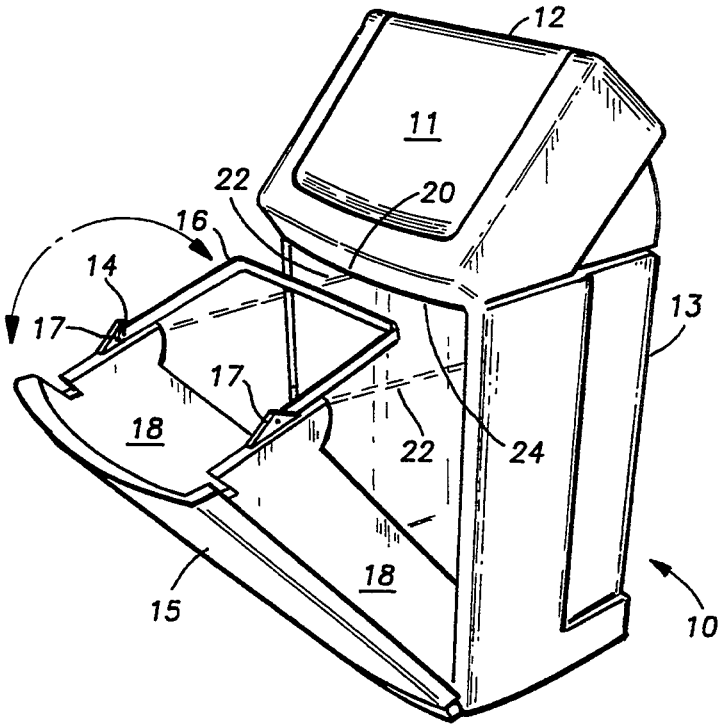
Figure 5A:
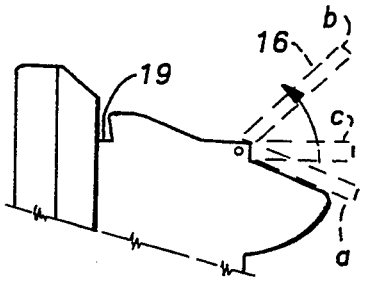
Figure 6:
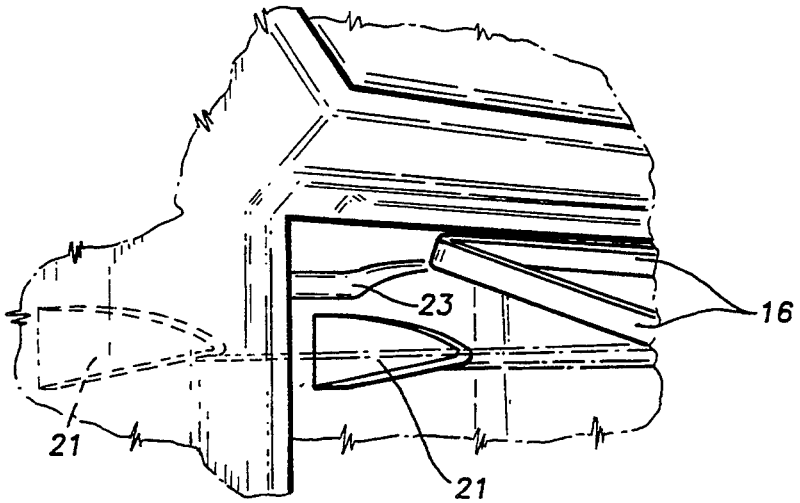

FIGS. 3 and 4 are diagrams illustrating the mode of operation of the supporting frame;

FIG. 5 is a perspective view from the front and one side of a swing-top refuse container with an opening front carrying a second embodiment of supporting frame in accordance with the invention, FIG. 5A is a partial side view of the swing top refuse container of FIG. 5, and FIG. 6 is a scrap view from the front and other side of FIG. 5 looking upwardly into the body of the container.

Referring now to FIGS. 1 to 4, a refuse container 1 (of the kind intended to be mounted on a street cleaners' hand cart adjacent a like container) is of generally square shape in plan with a downwardly tapering body 2 integrally moulded in synthetic plastics material. The open top of the container 1 is closed by a lid (not shown) resting on the upper edge 3. Side handles 4 are provided at opposite sides of the container but form no part of the present invention. Slightly below the edge 3 is an integrally moulded internal ledge 5 on which rests a supporting frame 6 indicated in position in chain-dot line in FIGS. 1 and 2 and more clearly illustrated in the insets to those Figures. The edge 3 and ledge 5 may have their bag-contacting surfaces (see below) made of a resilient or high friction material. The supporting frame 6 is of generally square shape conforming to, but slightly smaller than, the edge 3. As seen in the right-hand inset to FIG. 1 there is a slight clearance between the frame 6 and the edge 3. The frame 6 is made in two symmetrical halves of galvanised steel which are connected to each other and to the edge 3 by rivets 7 as more clearly shown in the lower inset to FIG. 2 which shows the overlapping ends of the halves of the frame 6. The rivets 7 permit relative pivotal movement of the halves of the frame 6 between the fully open position illustrated in FIGS. 1, 2 and 4 and the collapsed or folded position shown in FIG. 3. In the fully open position the frame 6 halves are in a stable over-centre position relative to the pivot axis defined by the rivets 7, such arrangement tending to lock the frame 6 into the open position.

In use, with the container 1 empty, the supporting frame 6 is used to suspend a refuse bag 8 from the edge 3 of the container 1. The refuse bag 8 is of the kind commonly employed in such containers being made of synthetic plastics material in a shape generally conforming to the interior of the container and having an openable mouth which in a conventional arrangement would be stretched ever the edge 3. In the present case, however, the bag 8 is introduced into the container 1 through the frame 6 and the mouth of the bag 8 is then positioned over the frame 6 while the latter is in the upwardly folded condition illustrated in FIG. 3. The frame 6 is then returned to its fully open position illustrated in FIG. 4 so as to trap the upper edge of the bag 8 between the frame 6 and the container edge 3 and ledge 5 thereby holding the bag 8 in the suspended position (see particularly the inset to the right of FIG. 1). Not only is the bag 8 more securely attached to the container but there is no unsightly protrusion of the bag from the container and in fact the bag cannot be seen when the lid is in position. The frame positions illustrated in FIGS. 3 and 4 are diagrammatically represented at the top of FIG. 1. The line III—III indicates the folded condition and the line IV—IV the fully open position of the frame 6. It will be appreciated that movement between the two positions involves an over-centre toggle action from an under-centre position III—III through a centre position indicated by line I—I and into a stable over-centre position IV—IV which is shown somewhat exaggerated in the drawing.

Referring now to FIGS. 5 and 6, a refuse container 10 has an access opening covered by a swing lid 11 pivoted adjacent its upper edge 12. Below the swing lid 11 the container 10 has a generally rectangular body 13 in which a refuse bag (not shown) is suspended by a supporting frame 14 provided at the top of a front panel 15 which is hinged at its bottom edge so as to be movable from the illustrated open position (in which it is restrained by removable lateral restraints 22 shown in chain-dot line) into a closed position in which the panel 15 forms the front wall of the container body 13.

The supporting frame 14 is constituted partly by a U-shaped metal element 16 (similar to one of the halves of the supporting frame 6 of the first embodiment) which is pivoted at its free ends to lugs 17 integral with side cheeks 18 of the front panel 15. The top edges of the side cheeks 18 slope downwardly and rearwardly when the panel 15 is upright (see the inset to FIG. 5). In the open position of the panel 15 the metal frame element 16 rests on the lower part of these edges (position a of the inset to FIG. 5). In this position the frame element 16 is in a stable over-centre position corresponding to position IV—IV in FIG. 1. The upper part of each edge is provided with a notch 19. When fitting a refuse bag the mouth of the bag at the front thereof is positioned in these notches 19 with the metal frame 16 folded upwardly into the under-centre position b in the inset of FIG. 5. When the metal frame 16 is then toggled back to the position a the mouth of the bag is stretched open. Furthermore, the frame 16 in position a is inclined rearwardly and downwardly parallel to the top edge of the side cheers 18 so as to clear the top edge 20 of the body opening which is closed by the panel 15. As the panel 15 is closed the leading edge of the frame 16 engages ramps 21 suitably positioned internally of the side walls of the body 13 so as to deflect the frame element 16 into the under-centre position c in the inset of FIG. 5 thereby maximising the height of the bag relative to the available space within the body 13. Movement of the frame element 16 above the position c, with consequent relaxation and possible detachment of the suspended bag, is prevented by the lower edge of an internal surface 23 which also provides a guide surface for directing refuse from the access opening into the bag. During opening movement of the panel 15 the upper edge 24 of the body opening deflects the frame element 16 back into the stable over-centre position a.

The engagement of the mouth of the bag with the frame 16 is similar to that described in the first embodiment i.e. the bag is suspended within the frame element 16 and the upper edge of the bag overlaps the frame 16 so as to be positioned and possibly trapped between the frame 16 and the adjacent parts of the body 13 in use. For bag removal the front panel 15 is tilted open into the illustrated position when the bag can easily be lifted out, if necessary by pivoting the frame element 16 into the illustrated position b. In order to facilitate cleaning of the body 13 the bottom hinges of the panel 15 are so designed that after removing the lateral restraints 22 the panel 15 may be lifted out of engagement with the body 13 so as to provide a clear front opening of the body 13.

It will be appreciated that modifications may be made without departing from the scope of the invention. For example, in the first embodiment the container may be of different shape, e.g. of circular section as in the case of many household dustbins. Although the toggle action is an essential feature of the first embodiment it may be omitted in the second embodiment if the bag is not stretched over the suspension frame to such an extent that the tension in the bag tends to close the frame. In this case the position a as well as the position c (FIG. 5) may be under-centre positions.

We claim:

1. A refuse container comprising a hollow body with an upper access opening closed by a displaceable cover, and a bag suspension frame carried by a body wall movable between a closed position in which the frame is positioned below the access opening and an open position in which the frame is exposed for bag replacement, said frame having a movable frame element projecting away from the wall and the body having internal surfaces for deflecting said frame element upwardly during closing movement and downwardly during opening movement of the wall.

2. A refuse container as claimed in claim 1, wherein the body wall is pivoted at its lower end such that the frame describes an arcuate path in moving between the open and closed positions of the wall.

3. A refuse container as claimed in claim 2, wherein said body wall has inwardly directed side cheeks for guiding movement of the wall, and upper edges of said side cheeks form part of said bag suspension frame and provide support for said frame element pivotally mounted thereon.

4. A refuse container as claimed in claim 3, wherein said edges have respective notches adjacent their outer ends for assisting bag retention.

5. A refuse container as claimed in claim 3, wherein said frame element is held in a stable over-centre position when the body wall is open and in an under-centre position when the body wall is closed.

* * * * *